US006616137B2

(12) United States Patent
Kaya et al.

(10) Patent No.: US 6,616,137 B2
(45) Date of Patent: Sep. 9, 2003

(54) ADJUSTABLE NEEDLES FOR A SHEET SEPARATING DEVICE

(75) Inventors: Mehmet Oktay Kaya, Lee, NH (US); Heiner Philipp Luxem, Durham, NH (US)

(73) Assignee: HeidelbergerDruckmaschinen AG, Heidelburg (DE)

( * ) Notice: Subject to any disclaimer, the term of this patent is extended or adjusted under 35 U.S.C. 154(b) by 0 days.

(21) Appl. No.: 09/939,428

(22) Filed: Aug. 24, 2001

(65) Prior Publication Data

US 2002/0105134 A1 Aug. 8, 2002

Related U.S. Application Data

(60) Provisional application No. 60/266,247, filed on Feb. 2, 2001.

(51) Int. Cl.[7] ..... B65H 3/08

(52) U.S. Cl. ..... 271/101; 271/104; 271/134; 271/106

(58) Field of Search ..... 271/94, 101, 103, 271/104, 106, 107, 134

(56) References Cited

U.S. PATENT DOCUMENTS 1,920,001 A * 7/1933 Chambers ..... 271/101
2,161,866 A * 6/1939 Huckins ..... 271/104
3,741,535 A * 6/1973 Palkovic et al. ..... 271/101
3,893,664 A * 7/1975 Thomsen ..... 271/100
3,988,016 A 10/1976 Merker et al. ..... 270/55
4,157,692 A 6/1979 Brocklehurst et al. ... 112/262.3
5,535,998 A * 7/1996 Geffert et al. ..... 271/99
6,070,866 A * 6/2000 Wepfer ..... 271/10.11
6,155,554 A * 12/2000 Helm et al. ..... 271/94

* cited by examiner

*Primary Examiner*—Patrick Mackey
(74) *Attorney, Agent, or Firm*—Davidson, Davidson & Kappel, LLC

(57) ABSTRACT

An apparatus for separating a flat product from a pile of flat products includes at least two needles arranged in at least one needle group on a respective needle block. The needle blocks and needle groups are movable from a closing position to an opening position, the needles supporting the bottom of the pile of flat products in the closing position. A respective adjustment device is provided for adjusting the position of each needle group, while a respective individual needle adjustment device may additionally provided for each needle.

21 Claims, 7 Drawing Sheets

ADJUSTABLE NEEDLES FOR A SHEET SEPARATING DEVICE

This is a non-provisional application claiming priority to Provisional Application No. 60/266,247 filed on Feb., 2, 2001, which is hereby incorporated by reference herein.

BACKGROUND OF THE INVENTION

1. Field of the Invention

The present invention relates generally to apparatus for separating flat products from a pile of flat products, and more particularly to an apparatus for separating flat products from a pile of flat products, the apparatus including adjustable needles movable from a closing position to an opening position wherein the adjustable needles support the bottom of a pile of flat products in their closing position.

2. Background Information

In the technology of building books, including booklets, magazines, periodicals, and the like, the use of collating systems is well known. These systems typically have a transporting device on which individual flat products, such as signatures or sheets, are gathered to build a book-block set, which then is finished and bound. Typically, a number of feeders are arranged along the transporting device, each of the hoppers comprising a feeding mechanism for feeding an individual flat product from a pile of signatures onto the transporting device, in order to gradually build up the book-block set or to insert a supplement sheet into a pocket of a pocket feeder or into a newspaper arranged in the pocket. Such feeding mechanisms typically employ a sheet-separating device for separating a sheet or other single flat product from a pile of flat products which is arranged in each hopper. The single flat products are drawn from the pile at its bottom end.

A sheet-separating device of this kind is known, for example, from U.S. Pat. No. 3,988,016. This document describes a high-speed paper inserting apparatus for vacuum gripping member grips the lowermost insert from the stack and carries it to a pair of nip rollers which transport the insert to an opened newspaper. A single sheet requires a different sucker stroke than a 120 page or pre-inserted section. The different sucker motion requirements are due to the way the sheets or sections have to be positioned and controlled for proper singulation. Generally, the bottom of the stack is supported by a platform, a so-called signature table having a recess for allowing a sucker to draw a single product from the lowermost end of the pile of products. When the sucker does not contact the pile of products the pile is supported by a movable hook, as shown in U.S. Pat. No. 4,157,692.

Efforts regarding such systems have led to continuing developments to improve their versatility, practicality and efficiency. One area in particular which has required further improvement is the support of the pile of products during the transition times between openings and closings of the lift hook and sucker.

SUMMARY OF THE INVENTION

It is an object of the present invention to provide a sheet-separating device with improved separation of the lowermost product of the pile of products.

The present invention provides an apparatus for separating flat products from a pile of flat products, the apparatus including: a plurality of needles arranged in at least one needle group; a respective needle block associated with each needle group, the associated needles being disposed thereon, the respective needle block being movable from a closing position to an opening position, the associated needles supporting a bottom of a pile of flat products when the respective needle block is in the closing position and in the opening position; and a respective group adjustment device associated with each needle group for adjusting a group position of the respective needle group.

Only first and second needle groups may be provided.

An individual needle adjustment device associated with each of the plurality of needles may be provided for adjusting an individual position of the respective needle. The respective distance each of the plurality of needles protrudes under the bottom of the pile of flat products between the closing position and in the opening position may be a function of the individual position of the respective needle. Each individual needle adjustment device may include a set screw arrangement.

The respective distance each of the plurality of needles protrudes under the bottom of the pile of flat products between the closing position and the opening position may be a function of the group position of respective needle group.

A face plate may be provided, each of at least one of the plurality of needles protruding through the face plate when the associated needle block in the closing position and the opening position.

Each group adjustment device may include a nut and screw arrangement. Each group adjustment device may be remotely controllable.

A lift hook and a suction device may be provided.

The present invention also provides a method for separating flat products from a pile of flat products, the method including: providing a plurality of needles arranged in at least one associated needle group disposed on a respective needle block movable from a closing position to an opening position; moving each of the respective needle blocks between the opening and the closing position so as to support a bottom of a pile of flat products using the associated needles by adjusting a group position of each of the respective needle group using a respective group adjustment device associated with the respective one needle group.

Using the present invention, which employs needles to support the signatures during transition between closing and openings of the lift hook and sucker in a flat product-separation device, a finer control of product-separation operations may be achieved, with improved singulation.

BRIEF DESCRIPTION OF THE DRAWINGS

The present invention is elaborated upon below with reference to the accompanying drawings.

DETAILED DESCRIPTION

The terms used herein have the same meanings herein as in the printing industry and sciences. Likewise, it will be understood that the usefulness of the present invention is not limited to a particular print machine, although the invention has especial usefulness in connection with such machines. The following description may be viewed in light of the print machines art, exemplary print systems being the Pacesetter products manufactured by Heidelberg Web Systems, Inc. of Heidelberger Druckmaschinen AG.

Figure 1:
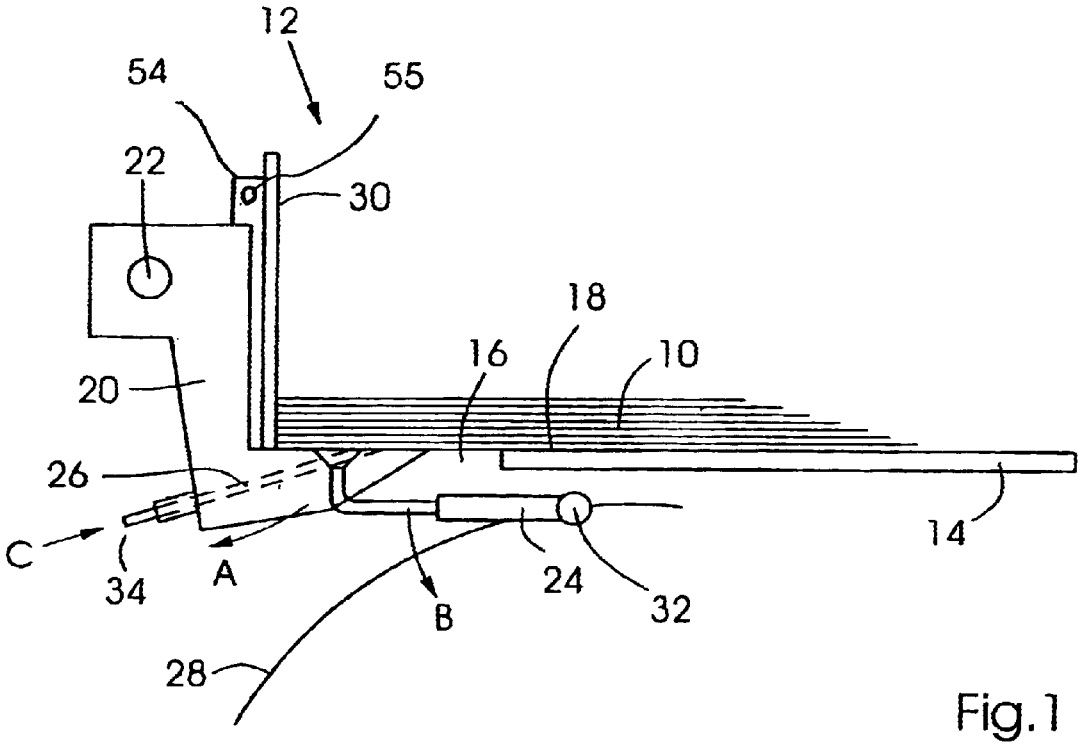
FIG. 1 shows a schematic right side view of a sheet-separating device with the lift hook in its closing position.
Figure 2A:
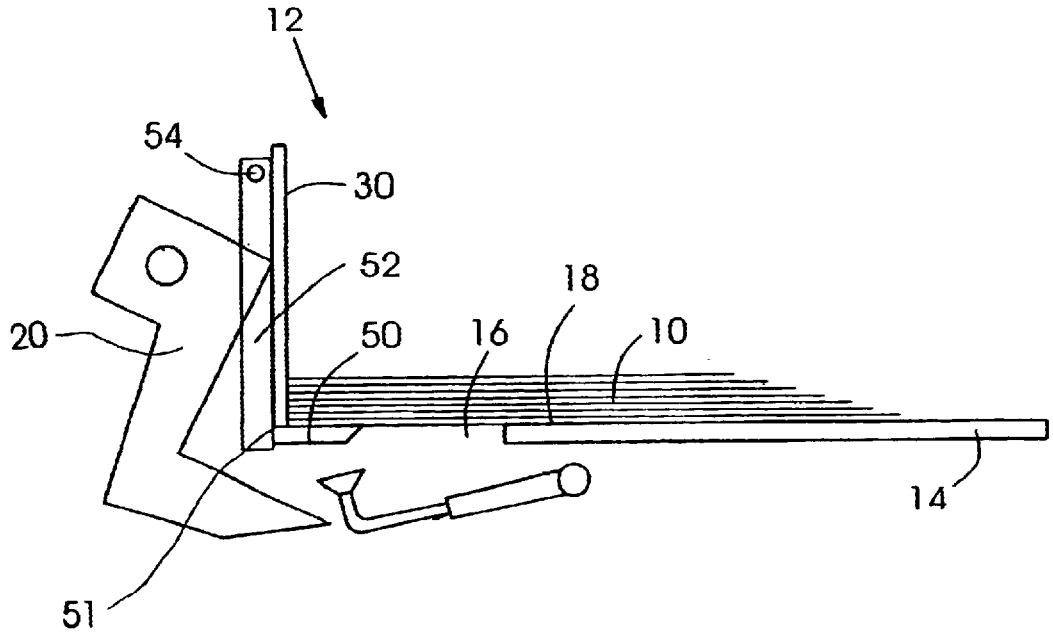
FIG. 2*a* shows a schematic right side view of a sheet-separating device with the needle group in its closing position.
Figure 2B:
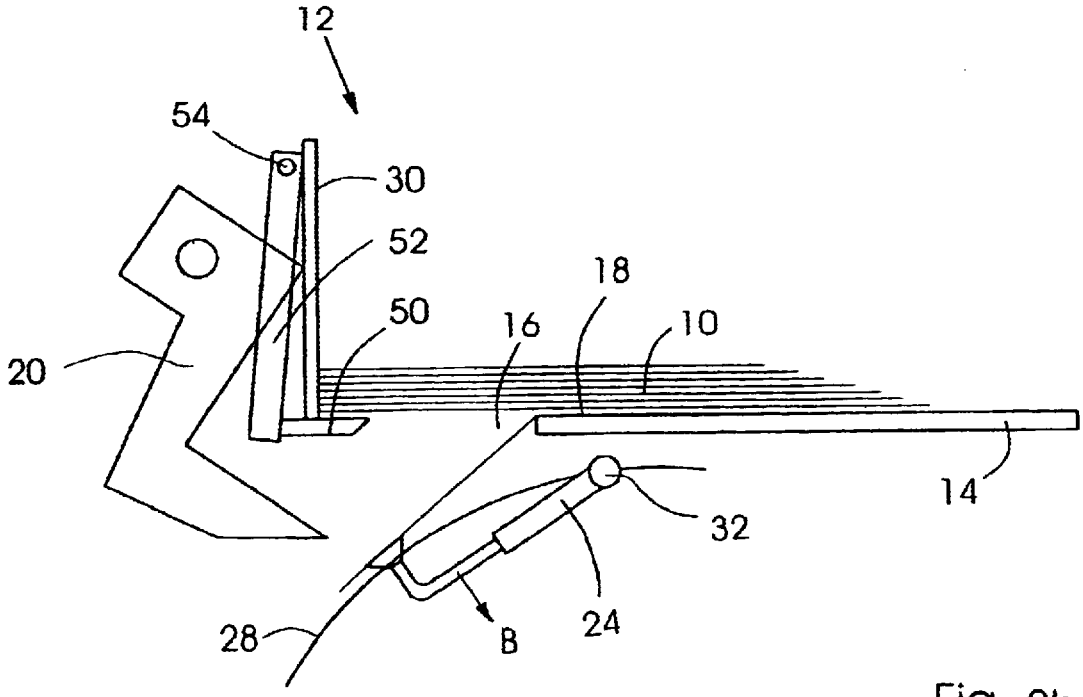
FIG. 2*b* shows a schematic right side view of a sheet-separating device with the needle group in its opening position.

Referring now to the drawings wherein like reference numerals designate like or corresponding parts throughout different views, there is shown in FIGS. 1, 2*a* and 2*b* schematic side views of a sheet-separating apparatus according to the present invention. Pile of flat products 10, especially of sheets or signatures of paper or plastic, are arranged in hopper 12 and lay flat on signature table 14. In order to be able to draw bottommost sheet 18 of pile 10, gap or recess 16 is provided on the bottommost end of pile 10. Lift hook 20 is provided to support pile 10 when lift hook 20 is in its closed position as shown in FIG. 1. Lift hook 20 is movable from a closed position to an opening position (FIGS. 2*a*, 2*b*) where the lift hook preferably is rotatably mounted on pivot point 22. Therefore it is possible to rotate lift hook 20 in the direction given by arrow A so that sucker 24 can draw down bottommost signature 18 from pile 10. Sucker 24 is rotatably mounted on sucker pivot point 32 and can be rotated in the direction given by arrow B. The sucker momentarily attaches to the bottommost signature in order to perform this function. Lift hook 20 and sucker 24 are known in art and may include a variety of features and enhancements.

Referring to FIGS. 2*a* and 2*b*, the signatures rest against front guide, or face plate, 30. During the transition between closing and openings of the lift hook and sucker, the signature stack is supported with at least one needle or a plurality of needles 50 protruding through opening 51 in the front guide in a closing position. To adjust the ability of sucker 24 to pull the bottommost signature, the needles are adjusted between the opening and the closing position. The needles are connectively associated through mounting or otherwise to at least one or a plurality of needle blocks 52. The needle blocks and associated needles transition from an opening and closing position by rotation about a pivot point 54 on stationary blocks 55. Stationary blocks 55 provide further support for the structure.

Needles 50 may be any suitable elongated members and may have, for example, a circular cross-section. Needles 50 may have a tapered, generally conical end, as shown in the figures, though other shapes are possible. Any of a variety of materials may be used to form needles 50, such as metal, plastic, etc.

The length needles 50 protrude through face plate 30 is important, because if the needles protrude too far, sucker 24 cannot effectively remove the signature 18, and if the needles protrude too little, they will not effectively support the signature.

To this end, there is provided, referring to FIGS. 3, 4*a*, 4*b*, 5 and 6, two needle position adjustments. Individual needle adjustment mechanism 60 is adapted to set the position of each needle 50. Group needle adjustment mechanism 62 is adapted to adjust the position of needle groups 66, 68. Movement of each needle group is transmitted through control arm 70, 72. Needle adjustments may be beneficial to optimize the operation of the sheet-separation apparatus for different types or sizes of flat products. Such adjustments may be based on empirical trials, for example, to determine which needle position(s) work best for a particular type or size of product. In some cases it may be beneficial to adjust individual needles of the same group to different positions, which may be accomplished using individual needle adjustment mechanism 60.

Individual needle adjustment mechanism 60 may include a set screw arrangement for holding the respective needle at a certain position. Set screws are widely used for such purposes, although any of a number of adjustment mechanisms as would be well known to those of skill in the art, may be employed.

Group needle adjustment mechanism 62 is provided in conjunction with or connection with control arms 70, 72. It can be seen that the needles are arranged in a plurality of groups 66, 68. Each group of needles has an associated needle block 52, group needle adjustment mechanism 62, and control arm 70. The group needle adjustment mechanism adjusts the position of a group of needles. In some embodiments according to the present invention, more than one, or a group of needles may be adjustable at a time by arranging the needles in groups with an associated group block and group adjustment. The number of needles in each group may vary depending on the particular requirements and the number illustrated is for exemplary purposes only.

Figure 3:
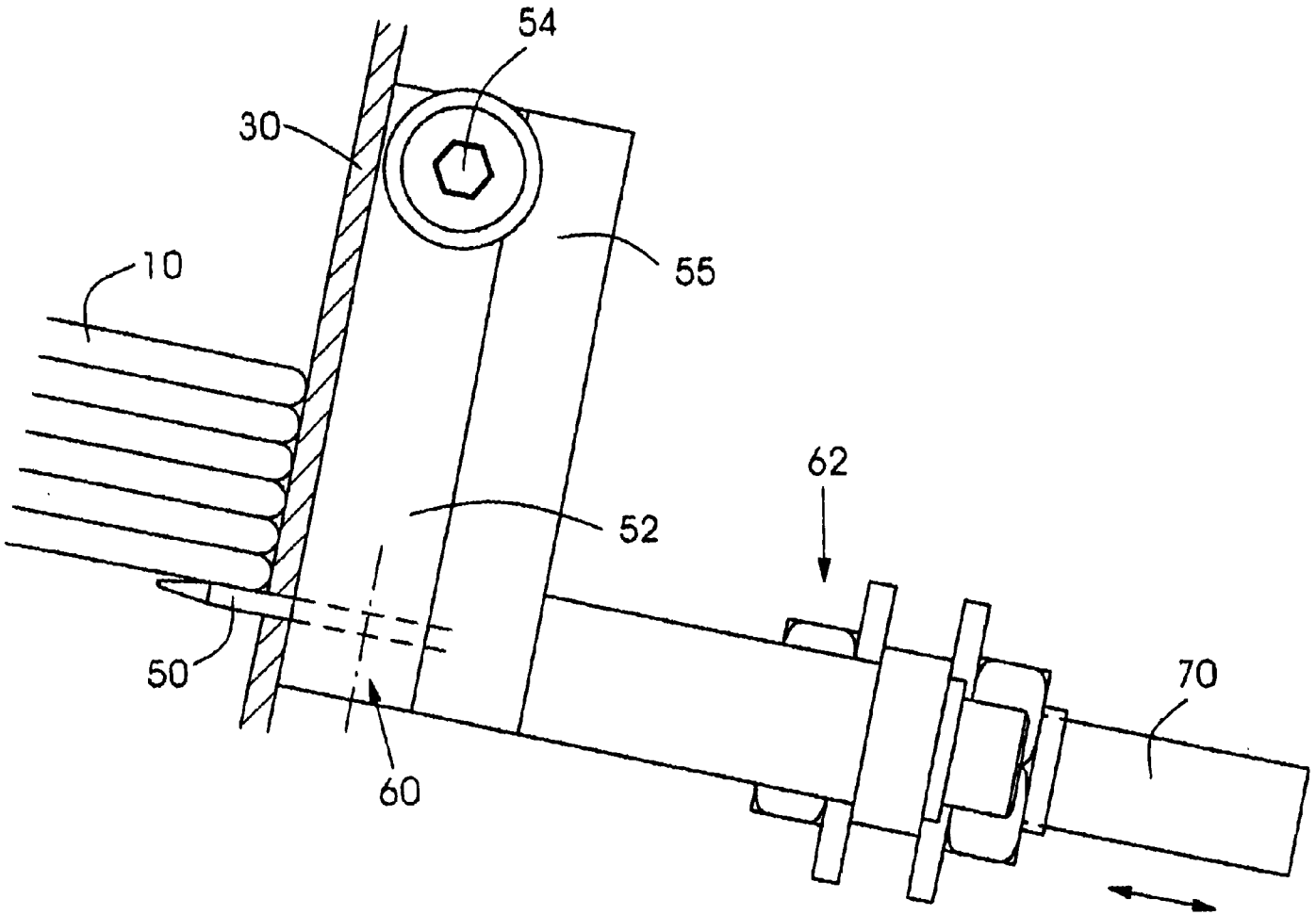
FIG. 3 shows a schematic left side view of a sheet-separating device with the needle group in its closing position.
Figure 4A:
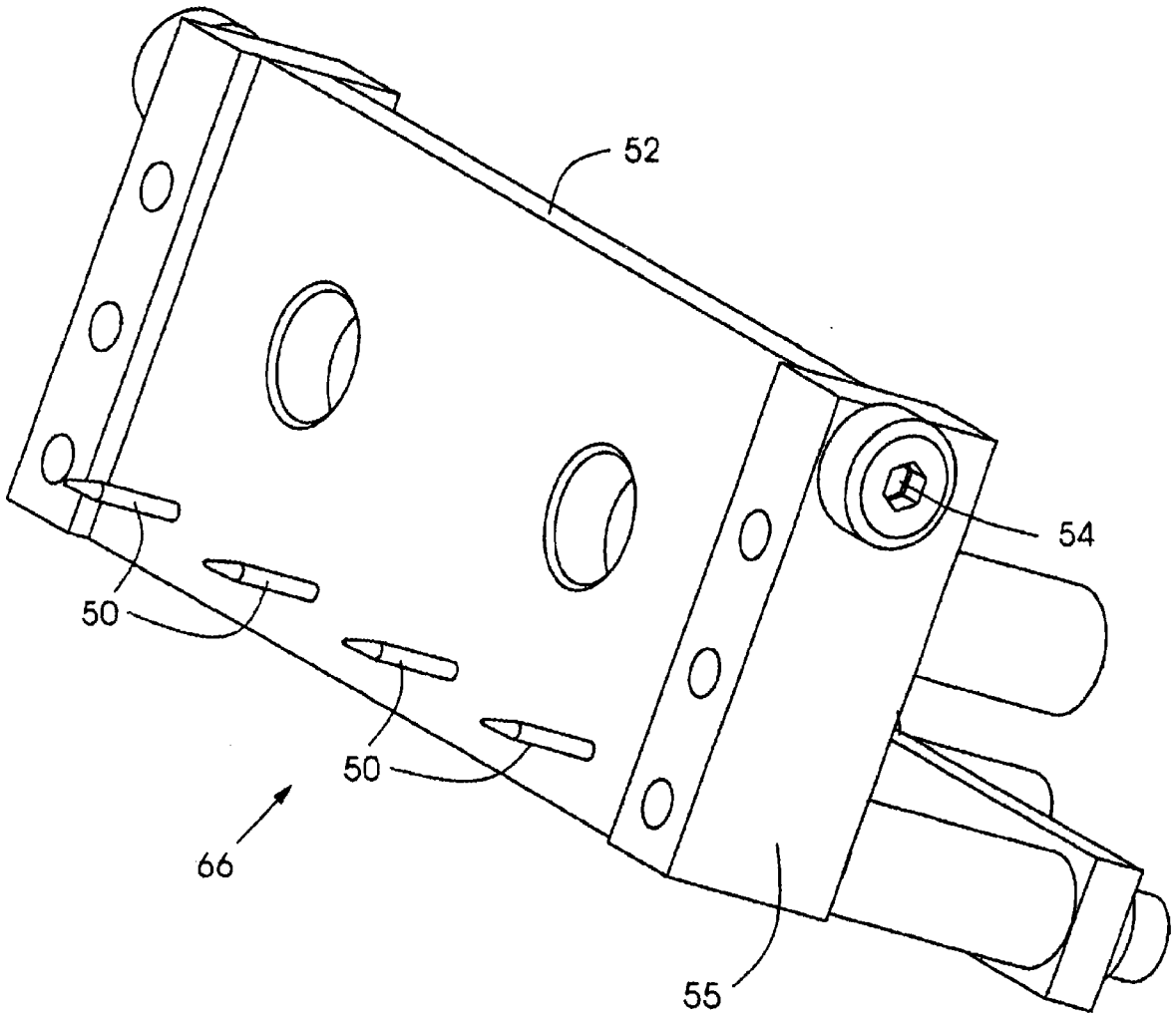
FIG. 4*a* shows a schematic perspective view of a sheet-separating device with the needle group in its closing position.
Figure 4B:
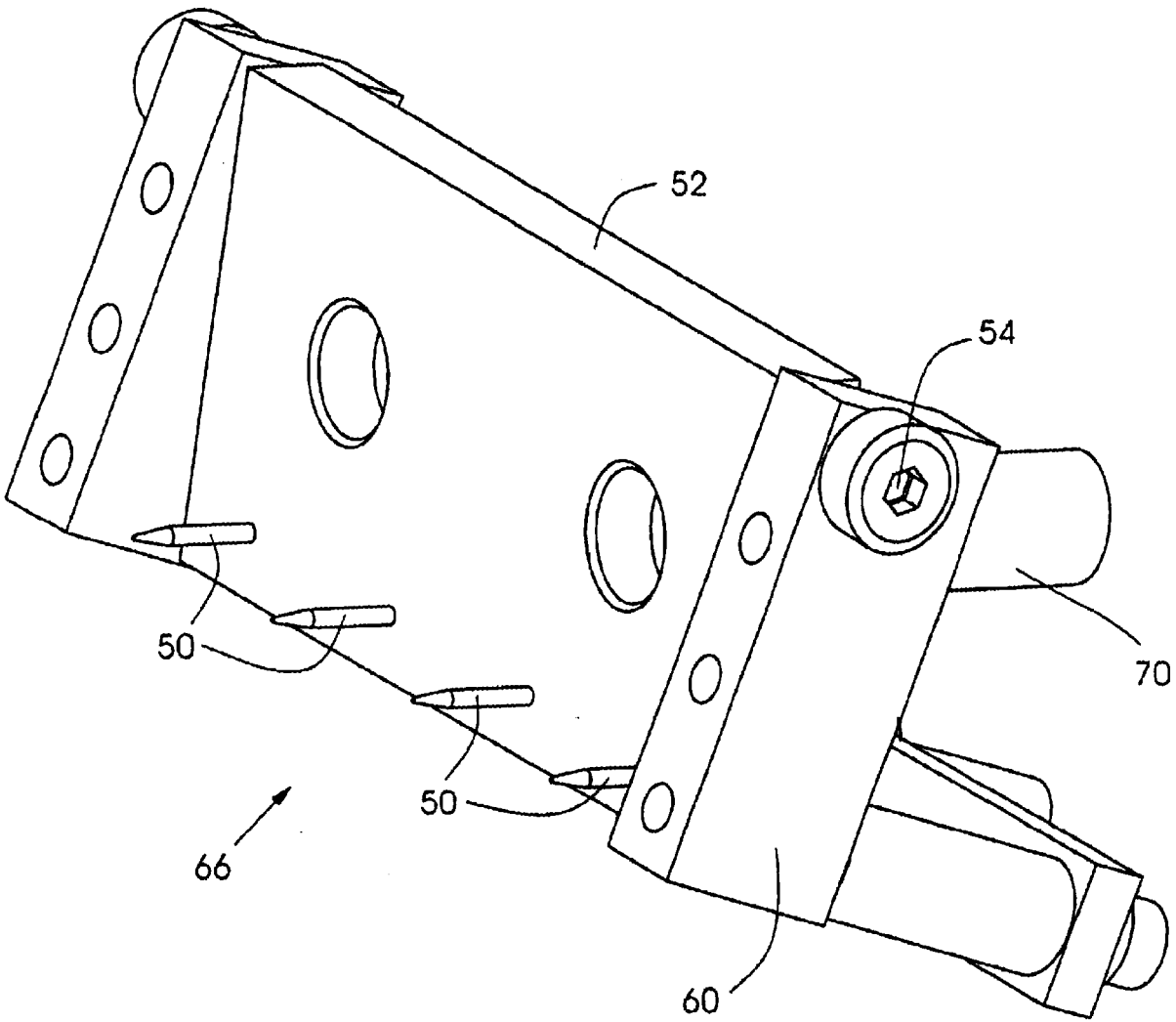
FIG. 4*b* shows a schematic perspective view of a sheet-separating device with the needle group in its opening position.
Figure 5:
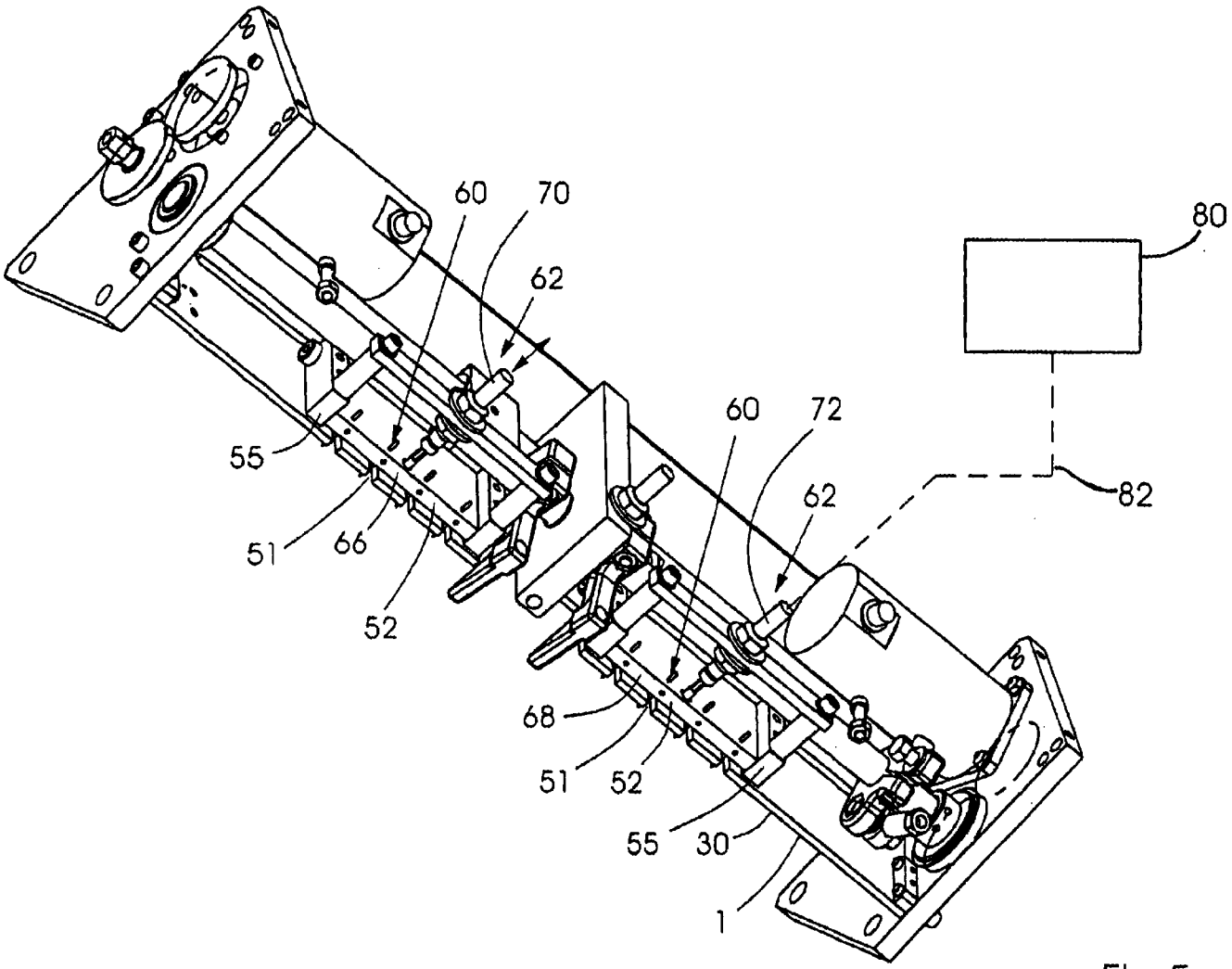
FIG. 5 shows a schematic perspective view of a sheet-separating device including a controller and a mechanical driver.
Figure 6:
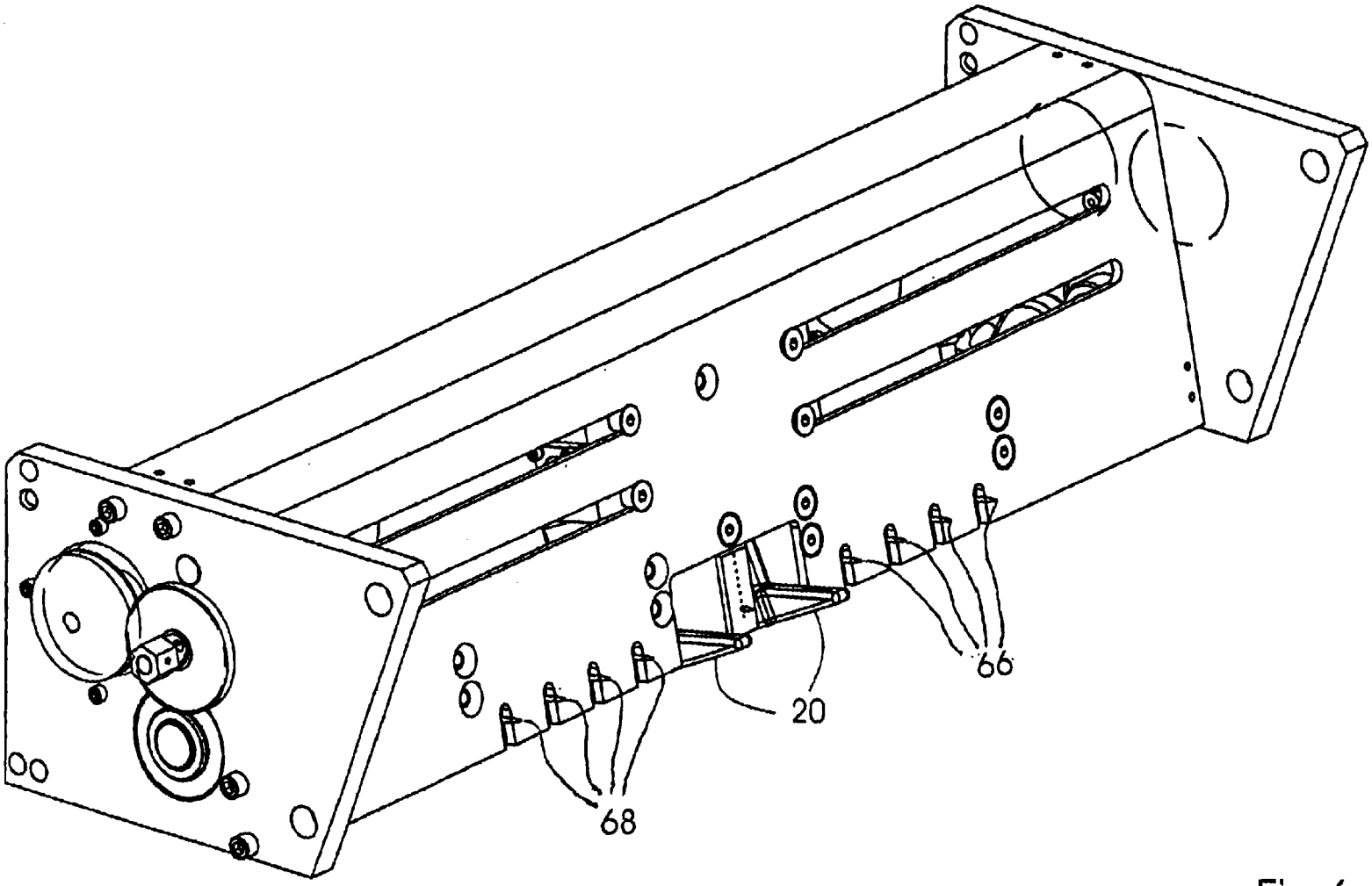
FIG. 6 shows a schematic perspective view of a sheet-separating device.

Group needle adjustment mechanism 62 may be any of a number of adjustment mechanisms, the details of which would be well known to those of skill in the art. For example, a matching threaded nut and screw arrangement may be used, as depicted in FIG. 3, so that turning or rotating of one or the other of the matching threaded devices will effectuate movement of needle group 66, 68 relative to stationary block 55 and face plate 30. Adjustment of needle group 66, 68 may be effected through control arm 70, 72, so that the needles may be adjusted remotely and, perhaps, during operation of an associated printing press. Such an arrangement could be used to automatically and/or remotely adjust the needles. A remotely controlled presetting of the needle groups may be effected to adjust for characteristics of the flat products, e.g., paper, and/or to adjust for parameters of a machine, e.g., a printing press, processing the flat products. Such flat product characteristics may include paper format and thickness, and machine parameters may include press speed, for example. The adjustment mechanism may be remotely operated by a controller 80 which has an electronic interface 82 controlling a mechanical driver as illustrated in FIG. 5.

It will of course be understood that the present invention has been described above only by way of example and that modifications of details should be understood by those skilled in the art and that various other changes, omissions and additions may be made therein and thereto without departing from the spirit and scope of the invention.

What is claimed is:

1. An apparatus for separating flat products from a pile of flat products, the apparatus comprising:

a plurality of needles arranged in at least one needle group;

a respective needle block associated with each of the at least one needle group, the associated needles being disposed thereon, the respective needle block being movable between a closing position and an opening position, the associated needles supporting a bottom of a pile of flat products when the respective needle block is in the closing position and in the opening position; and a respective group adjustment device associated with each of the at least one needle group for adjusting a group position of the respective needle group between the closing position and the opening position.

2. The apparatus as recited in claim 1 wherein the at least one needle group includes only a first and a second needle group.

3. The apparatus as recited in claim 1 further comprising an individual needle adjustment device associated with each of the plurality of needles for adjusting an individual position of the respective needle.

4. The apparatus as recited in claim 3 wherein a respective distance each of the plurality of needles protrudes under the bottom of the pile of flat products is a function of the individual position of the respective needle.

5. The apparatus as recited in claim 3 wherein each of the respective individual needle adjustment devices includes a set screw arrangement.

6. The apparatus as recited in claim 1 wherein a respective distance each of the plurality of needles protrudes under the bottom of the pile of flat products is a function of the group position of respective needle group.

7. The apparatus as recited in claim 1 further comprising a face plate, at least one of the plurality of needles protruding through the face plate when the associated needle block in the closing position and in the opening position.

8. The apparatus as recited in claim 1 wherein each of the respective group adjustment device includes a nut and screw arrangement.

9. The apparatus as recited in claim 1 wherein each of the respective group adjustment devices is remotely controllable.

10. The apparatus as recited in claim 1 further comprising a lift hook and a suction device, the lift hook having an opened and closed position, the needles supporting the pile when the lift hook is in the opened position.

11. A method for separating flat products from a pile of flat products, the method comprising:

providing a plurality of needles arranged in at least one associated needle group disposed on a respective needle block movable from a closing position to an opening position, the needles supporting a bottom of a pile of flat products in the closing position and the opening position;

moving each of the respective needle block between the closing position and the second position so as to adjust a group position of each of the at least one needle group using a respective group adjustment device associated with the respective needle group.

12. The method as recited in claim 11 wherein the at least one needle group includes only a first and a second needle group.

13. The method as recited in claim 11 further comprising using an individual needle adjustment device associated with each of the plurality of needles so as to adjust an individual position of respective needle.

14. The method as recited in claim 11 wherein a respective distance each of the plurality of needles protrudes under a bottom of the pile of flat products is a function of the individual position of the respective needle.

15. The method as recited in claim 11 wherein a respective distance each of the plurality of needles protrudes under a bottom of the pile of flat products is a function of the group position of respective needle group.

16. The method as recited in claim 11 further comprising providing a face plate for the pile and wherein the moving is performed so as to cause at least one of the plurality of needles to protrude through the face plate when the associated needle block in the closing position and the opening position.

17. The method as recited in claim 11 wherein each of the respective group adjustment device includes a nut and screw arrangement.

18. The method as recited in claim 11 further comprising remotely controlling each of the respective group adjustment device.

19. The method as recited in claim 11 further comprising remotely controlling each of the respective group adjustment device so as to automatically preset the respective needle group based on at least one of a characteristic of the flat products and parameter of a machine for processing the flat products.

20. The method as recited in claim 11 further comprising providing a lift hook and a suction device for intermittently supporting the pile and removing a bottommost product of the pile of products from the pile, respectively.

21. An apparatus for separating flat products from a pile of flat products, the apparatus comprising:

a lift hook movable between a closed position and an opened position, the lift hook contacting a bottom of the pile of flat products in the closed position and not contacting the bottom of the pile in the opened position; and a plurality of needles arranged in at least one needle group, the needles contacting the bottom of the pile at least when the lift hook is in the opened position;

a respective needle block associated with each of the at least one needle group, the associated needles being disposed thereon, the respective needle block being adjustable between a first position and a second position; and a respective group adjustment device associated with each of the at least one needle group for adjusting the respective needle group between the first and second positions.

* * * * *